US007592927B1

(12) United States Patent
Marshall et al.

(10) Patent No.: US 7,592,927 B1
(45) Date of Patent: Sep. 22, 2009

(54) SYSTEM AND METHOD FOR MULTIPLEXING TRAFFIC SIGNALS AND BRIDGE COLLAPSE DETECTION

(76) Inventors: Robert A Marshall, 324 Doe Run, Georgetown, TX (US) 78628; Fred R Marshall, 1122 Post Rd., Carencro, LA (US) 70520

( * ) Notice: Subject to any disclaimer, the term of this patent is extended or adjusted under 35 U.S.C. 154(b) by 362 days.

(21) Appl. No.: 11/164,740

(22) Filed: Dec. 2, 2005

(51) Int. Cl.
*G08B 1/095* (2006.01)

(52) U.S. Cl. ..... 340/907; 340/915; 340/916; 340/917; 340/931; 340/854.9

(58) Field of Classification Search ..... 340/907, 340/915, 916, 917, 931, 668, 686.1, 687, 340/854.9, 855.1, 310.02, 310.06; 14/78; 398/21

See application file for complete search history.

(56) References Cited

U.S. PATENT DOCUMENTS 3,605,084 A * 9/1971 Matysek ..... 340/909
3,613,073 A * 10/1971 Clift ..... 340/920
6,487,914 B1 * 12/2002 Hodge ..... 73/800
7,333,028 B2 * 2/2008 Schwartz ..... 340/907

* cited by examiner

*Primary Examiner*—Hung T. Nguyen

(57) ABSTRACT

A system and method for controlling transportation traffic signal beacons including powering a signal, encoding a signal state, and decoding the signal state at the beacon is presented. Furthermore, traffic signal beacons may be placed along the length of a bridge to warn of a bridge collapse. The metallic cable that powers the beacons may also function as a bridge collapse detection sensor.

20 Claims, 5 Drawing Sheets

SYSTEM AND METHOD FOR MULTIPLEXING TRAFFIC SIGNALS AND BRIDGE COLLAPSE DETECTION

TECHNICAL FIELD OF THE INVENTION

This invention relates generally to the field of transportation signaling and, more specifically, to a system and method of powering and controlling traffic signals. The invention is further expanded to include a bridge collapse detection system

BACKGROUND OF THE INVENTION

Traffic flow control allows safe and efficient travel for motorists. At a typical automotive intersection, motorists traveling in opposing directions are given alternating rights-of-way via a set of standardized traffic signal beacons. Each beacon consists of a recognizable combination of green, yellow, and/or red electric signal lamps enclosed in a standard housing. These beacons face the desired directions of travel and are controlled from a common point with one traffic signal controller. All lamps are electrically home-run to the controller using 120VAC or other high-voltage AC power. The controller selects which lamps to illuminate at any given time while a conflict monitor prevents unsafe combinations of lamp illumination. The lamps themselves may be incandescent with filters or one of a variety of LED styles. Common patterns include round balls, arrows, and "Xs." A UPS including a rectifier, battery, and inverter may be included at critical locations.

Another application of traffic flow control is a bridge collapse motorist warning system. While bridges are generally safe, they can fail. When they do, frequently motorists that were not even on the bridge at the time of collapse drive over the edge. This is because by the time motorists become aware of the hazard, they may no longer have adequate stopping distance. Bridge curvature can limit visibility of a hazard even under otherwise ideal visibility conditions. To limit this unnecessary loss of life and property, a series of flashing red traffic signal beacons may be spaced along the length of the bridge and driven by 120VAC line power, as further described in Mercier, J. J. and Marshall, R. A., "Bridge Collapse Detection and Motorist Warning System," IEEE ITS newsletter Vol 7, No 3, September 2005. There is one important drawback to this system. It is possible to short the beacon power to ground or to water, tripping a circuit breaker and causing all the bridge's beacons to go dark at the only time they are needed. While there is a method of mechanical disconnection of the damaged cable section which may reduce this risk, it does not guarantee critical operation.

A bridge collapse motorist warning system must be activated by a bridge collapse detection system, a means to detect the failure of the bridge. Frequently, a cable is run the entire length of the bridge with a break in the cable indicating a structural failure. U.S. Pat. No. 6,972,687, Marshall, et al., "System and Method for Detecting A Structure Failure" illustrates such a system using a fiber optic cable sensor. Unfortunately, fiber optic cable is difficult to grip and attach to fixed points on a bridge. Also, optical fibers and high voltage power are run in separate conduits or cables, which are both very costly and difficult to install.

SUMMARY OF THE INVENTION

In accordance with the present invention, a system and method to multiplex traffic signals with minimal conductor usage is disclosed that addresses disadvantages and problems associated with other systems and methods. The invention is further expanded to include a bridge collapse detection and motorist warning system.

A system and method of multiplexing traffic signals includes encoding a desired state of light illumination, where the encoded state cannot produce conflicting signal illumination; and providing power to the signals. Only a single pair of copper wires is required to control an entire intersection. All traffic signals are electrically in parallel on the single pair of control and power wires.

LED signals already employ active controls; each signal lamp includes a power supply to provide the proper illumination. In a beacon with one to three lamps, since only one signal is ever illuminated at any given time, a power supply in each signal lamp is wasteful. In accordance with the present invention, the output of the beacon's only power supply is directed to the appropriate signal lamps with a single decoded command from the traffic signal controller. The command is included on the same pair of wires as power, and only a single pair of wires is required to operate an entire intersection with turn lanes in all directions. For a four-way intersection with turn lanes, the thirty-five useful states of signal illumination are encoded, for example, with the polarity of the applied power and a single Dual Tone Multi Frequency digit. DTMF encoding takes advantage of very low-cost ICs from the telecom industry. Also, with LED signals, a low-voltage DC may be supplied to the signals, eliminating the inherent hazards with high-voltage AC and allowing the use of cheaper low-voltage wiring, such as telephone drop wire. This also allows a UPS to be replaced with a simpler rectifier and battery charger, eliminating the cost, power loss, and possible failure of an inverter.

This multiplexing method is also particularly useful in a bridge collapse detection and motorist warning system. Unnecessary loss of life and property can be significantly reduced with a reliable system to immediately and effectively detect and warn of a failed structure. A series of flashing red traffic signal beacons are spaced along a bridge to warn any motorist approaching or on the bridge of the impending peril. If all of the beacons are simply wired in parallel, any electrical fault on the wire will disable all beacons and fail to notify motorists. A collapsing bridge has the potential to fault the wiring during collapse. Home-run wiring eliminates this concern, as a short on any one beacon will not affect the others. This system only requires flashing red signals. Only three states are needed, so only polarity encoding is adequate. A single pair of wires may be routed to each beacon, containing two signal lamps. This saves one pair of wires per beacon, which can become very significant on mile-long causeways. The use of low-voltage DC allows the use of telephone drop wire, which does not need to be run in conduit, and eliminates the hazard of accidentally coming into contact with shredded power conductors after a collapse.

The same pairs of wire used to control the signals may also be used as a collapse detection sensor. This same or a separate pair of wires is monitored for the presence of an applied very low voltage at the opposite end of the bridge. Electrical continuity indicates that the bridge is still intact. This applied voltage must be low enough to not illuminate the signals on this same pair of wires. Alternately, a pair of wires may transmit a data signal, with loss of data indicating a bridge collapse. The cable must be periodically anchored to the bridge in a manner to ensure that the falling bridge will sever the cable, not simply allow it to stretch without breaking. This is of particular concern on low-rise causeways. Metallic cable is ductile and is manufactured by drawing, a controlled stretching process. At each anchor point, the metallic cable is strain-relieved and loosely spindled around a dull edge. The strain relief prevents any wear on the cable from the dull edge. In the event of a collapse, there is enough force on the metallic cable to pull out of the strain relief and be severed against the dull edge that it is now in full contact with.

Other technical advantages are readily apparent to one skilled in the art from the following figures, descriptions, and claims.

BRIEF DESCRIPTION OF THE DRAWINGS

For a more complete understanding of the invention, and for further features and advantages, reference is now made to the following description, taken in conjunction with the accompanying drawings, in which.

DETAILED DESCRIPTION OF THE INVENTION

Embodiments of the present invention and their advantages are best understood by referring to FIGS. 1 through 5 of the drawings, in which like numerals refer to like parts.

Figure 1:
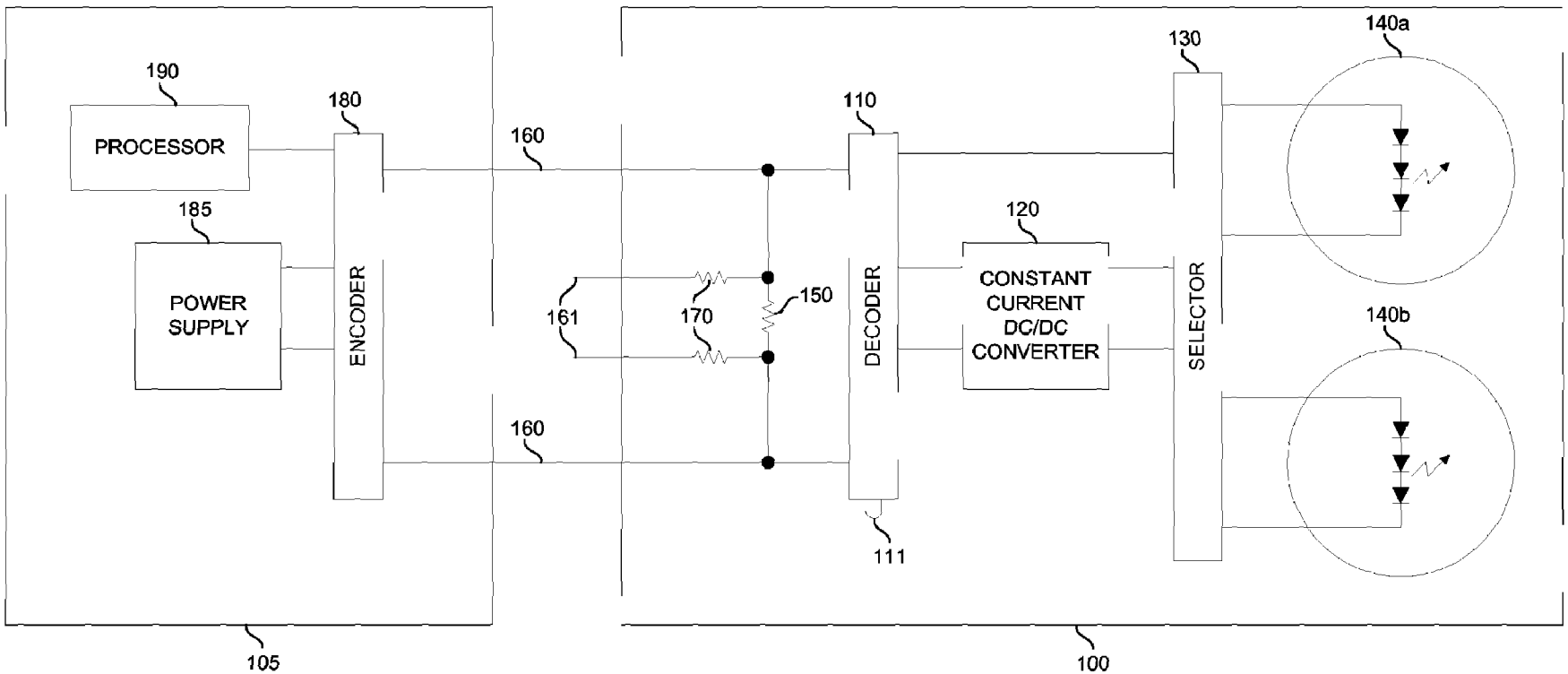
FIG. 1 shows a diagram of a system for controlling traffic signal beacons in accordance with the present invention.

FIG. 1 shows a diagram of one embodiment of a system for controlling traffic signal beacons. A traffic signal controller 105 contains a processor 190 which selects a desired state of a multitude of traffic signal lamps 140 to control the flow of motor vehicles in a desired fashion. A single logical state transmitted over a single pair of wires 160 describes the desired traffic flow for the entire intersection. Power supply 185 provides low-voltage DC power to operate traffic lights 140*a-b*. Power supply 185 may also include a backup battery. Encoder 180 encodes the desired state and also couples DC power to cable 160. Encoding of three states (top lamp on, bottom lamp on, and no lamp on) is possible using only the polarity of the applied power (positive, negative, and off). Any other encoding method is possible. A single pair of wires 160 may connect controller 105 to a multitude of beacons 100. Use of DC power allows elimination of an inverter associated with battery backup, allowing a little longer battery run-time.

At beacon 100, decoder 110 decodes the state transmitted by encoder 180 and controls selector 130 to apply power to the correct combination of lamps 140. The number of lamps 140 is determined by the characteristics of the traffic. Lamps 140 are LED lamps. However, incandescent lamps are not precluded. Decoder 110 also separates power from pair of wires 160 to couple to a constant current DC/DC converter 120. DC/DC converter 120 may or may not sense the temperature of the illuminated lamp 140 and temperature—compensate the current accordingly.

For example, a 4-way intersection may flash yellow in the main two directions of traffic flow (E/W) and flash red in the two crossing directions of travel (N/S). Each of the four directions require at least one flashing traffic signal beacon, each with two appropriately-colored traffic signal lamps. Only one pair of wires 160 are required to control the entire intersection as demonstrated by the following encoding table. Single pair of wires 160 is run in parallel to each beacon. Each beacon uses the polarity of single pair of wires 160 to determine which lamp (top or bottom) to illuminate.

Lamp Illumination Encoding Table

| | Beacons | | | |
|---|---|---|---|---|
| | Crossing - Red Flash | | Main - Yellow Flash | |
| Pair Polarity | Northbound | Southbound | Eastbound | Westbound |
| Positive | Top | Top | Top | Top |
| Negative | Bottom | Bottom | Bottom | Bottom |
| OFF | — | — | — | — |

Alternatively, a 4-way intersection with left turn lanes in all directions may also be easily controlled with a single pair of wires 160. Additional states are required due to the complexity of the intersection. These states are added by sending a single DTMF encoded digit. DTMF encoders and decoders are inexpensive due to their widespread use in POTS telephony dialing. However, any other well-known encoding method and state assignment may be used. Decoder 110 must be operable to decode red, yellow, green, red arrow, yellow arrow, and green arrow lamp states. The encoded states are selected to use the same DTMF digits for N/S and E/W directions; this is accomplished with only a polarity reversal of pair of wires 160 to some beacons 100. The combination of the polarity and DTMF inputs determine the encoded state as shown in the following table. Addition of jumper 111 allows identification of N or E from S or W, thus allowing a single version of decoder 110 to be used in every beacon 100 in the intersection.

Lamp Illumination Encoding Table

| | | Beacons | | | | | | | |
|---|---|---|---|---|---|---|---|---|---|
| | | Northbound | | Southbound | | Eastbound | | Westbound | |
| Pair Polarity | DTMF | Straight | Left Turn | Straight | Left Turn | Straight | Left Turn | Straight | Left Turn |
| Positive | 0 | G | R | G | R | R | R | R | R |
| Positive | 1 | Y | R | Y | R | R | R | R | R |
| Positive | 2 | G | G | R | R | R | R | R | R |

-continued

Lamp Illumination Encoding Table

| | | Beacons | | | | | | | |
|---|---|---|---|---|---|---|---|---|---|
| | | Northbound | | Southbound | | Eastbound | | Westbound | |
| Pair Polarity | DTMF | Straight | Left Turn | Straight | Left Turn | Straight | Left Turn | Straight | Left Turn |
| Positive | 3 | G | Y | R | R | R | R | R | R |
| Positive | 4 | G | R | R | R | R | R | R | R |
| Positive | 5 | Y | G | R | R | R | R | R | R |
| Positive | 6 | Y | Y | R | R | R | R | R | R |
| Positive | 7 | Y | R | R | R | R | R | R | R |
| Positive | 8 | R | R | G | G | R | R | R | R |
| Positive | 9 | R | R | G | Y | R | R | R | R |
| Positive | A | R | R | G | R | R | R | R | R |
| Positive | B | R | R | Y | G | R | R | R | R |
| Positive | C | R | R | Y | Y | R | R | R | R |
| Positive | D | R | R | Y | R | R | R | R | R |
| Positive | # | R | G | R | G | R | R | R | R |
| Positive | * | R | Y | R | Y | R | R | R | R |
| Positive | NO TONE | R | R | R | R | R | R | R | R |
| OFF | — | — | — | — | — | — | — | — | — |
| Negative | 0 | R | R | R | R | G | R | G | R |
| Negative | 1 | R | R | R | R | Y | R | Y | R |
| Negative | 2 | R | R | R | R | G | G | R | R |
| Negative | 3 | R | R | R | R | G | Y | R | R |
| Negative | 4 | R | R | R | R | G | R | R | R |
| Negative | 5 | R | R | R | R | Y | G | R | R |
| Negative | 6 | R | R | R | R | Y | Y | R | R |
| Negative | 7 | R | R | R | R | Y | R | R | R |
| Negative | 8 | R | R | R | R | R | R | G | G |
| Negative | 9 | R | R | R | R | R | R | G | Y |
| Negative | A | R | R | R | R | R | R | G | R |
| Negative | B | R | R | R | R | R | R | Y | G |
| Negative | C | R | R | R | R | R | R | Y | Y |
| Negative | D | R | R | R | R | R | R | Y | R |
| Negative | # | R | R | R | R | R | G | R | G |
| Negative | * | R | R | R | R | R | Y | R | Y |
| Negative | NO TONE | R | R | R | R | R | R | R | R |

For this selection of encoding method and states, decoder 110 needs only to decode the following states, as the beacon 100 location within the intersection is determined by jumper 111 and the polarity of wires 160.

Lamp Illumination Decoding Table

| | DTMF | | Beacon | |
|---|---|---|---|---|
| | Jumper | Jumper | | |
| Pair Polarity | ON | OFF | Straight | Left Turn |
| Positive | 0 | | G | R |
| Positive | 1 | | Y | R |
| Positive | 2 | 8 | G | G |
| Positive | 3 | 9 | G | Y |
| Positive | 4 | A | G | R |
| Positive | 5 | B | Y | G |
| Positive | 6 | C | Y | Y |
| Positive | 7 | D | Y | R |
| Positive | 8 | 2 | R | R |
| Positive | 9 | 3 | R | R |
| Positive | A | 4 | R | R |
| Positive | B | 5 | R | R |
| Positive | C | 6 | R | R |
| Positive | D | 7 | R | R |
| Positive | * | | R | G |
| Positive | # | | R | Y |
| Negative | OFF | | R | R |

With both examples, encoder 180 sends the state of the entire intersection over a single pair of wires 160. The type of intersection and sequence of progression through each beacon state is determined by the traffic engineer. Use of polarity coding reduces complexity of decoder 110. Also, a power supply is no longer required in each lamp, but only one per each beacon.

Additionally, processor 190 may monitor the current consumed in each state. Any significant variation in this current may indicate a failed lamp 140. Optionally, resistor 150 may provide a signature impedance for identification of beacon 100. Optionally, resistors 170 in conjunction with pair 161 may be added to allow for cable continuity checking of pair 160, without adding an additional opportunity for failure of pair 161 to disrupt the system.

Figure 2:
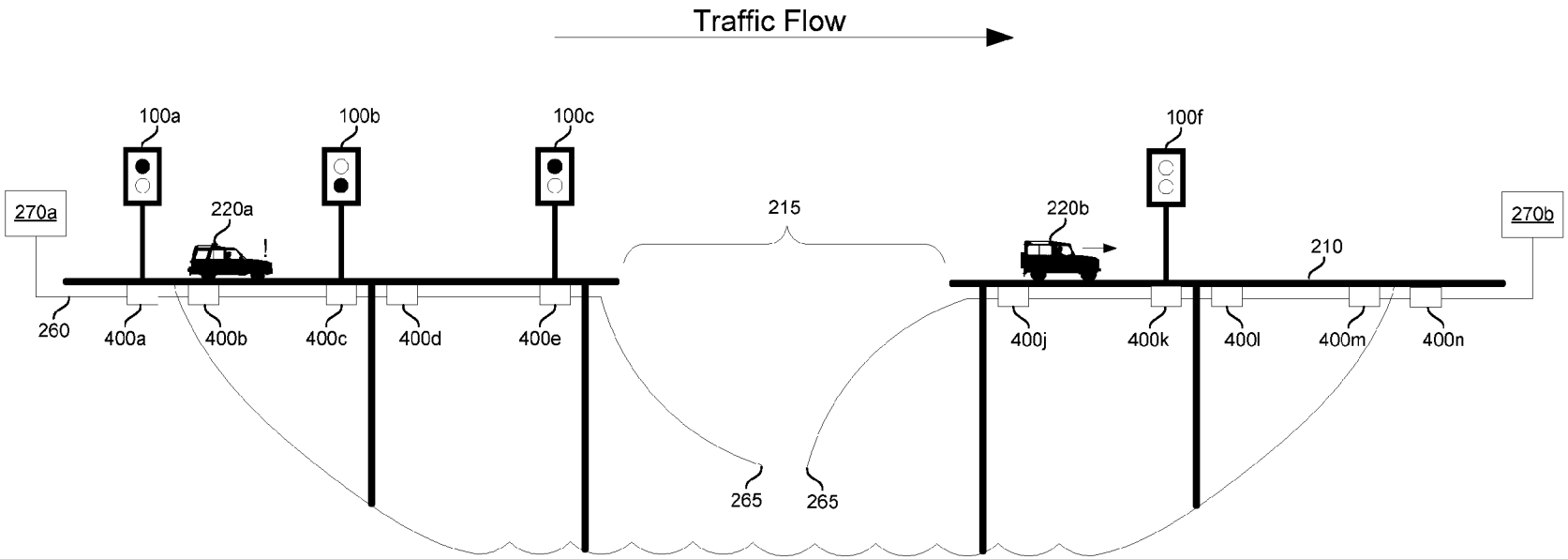
FIG. 2 is an illustration of a motorist warning and bridge collapse detection system in accordance with the present invention.

FIG. 2 is an illustration of one embodiment of a motorist warning and bridge collapse detection system. Such a system for controlling the flow of traffic may be installed on a bridge, causeway, or other transportation structure to stop the flow of traffic in the event of a collapse of the structure. A metallic cable 260 is run underneath bridge 210 for the length of bridge 210. A collapsed bridge section 215 will result in a parted cable 265. Controllers 270 monitor the integrity of cable 260 and upon loss of continuity, activate beacons 100. Only beacons 100 *a-c*, located before collapsed section 215, should be activated to stop motorist 220*a* from plummeting off the end of the bridge. Frequently, without a warning system, by the time motorist 220*a* becomes aware of collapsed section 215, adequate stopping distance is no longer available, and motorist 220*a* will fall into the water. Beacon 100*f*, located after collapsed section 215, should not be activated to allow motorist 220*b* to exit normally. Beacons 100 are flashing alternating red balls periodically spaced along the structure. Beacons 100 are shown on every span for illustrative purposes. They need not be placed every span and should be spaced according to stopping distance at highway speed, visibility, bridge geometry, and the type of bridge structure. For example, spacing can be on the order of 500 feet for highway speeds.

Key to creating parted cable 265 is cable anchor 400. Without a reliable way of attaching cable 260 to bridge 210, the collapsed section 215 may not actually break cable 260, but may simply stretch cable 260, especially if bridge 210 has a low rise. Metallic cables are subject to drawing, thus a cable anchor 400 is placed at each end of each span. In alternate embodiments, cable anchor 400 is placed less than every span, based on the bridge height and elastic modulus of the cable. Any other spacing is readily envisioned.

The same layout is repeated for each direction of traffic flow. Some elements of the system may be combined to service the entire bridge.

Figure 3:
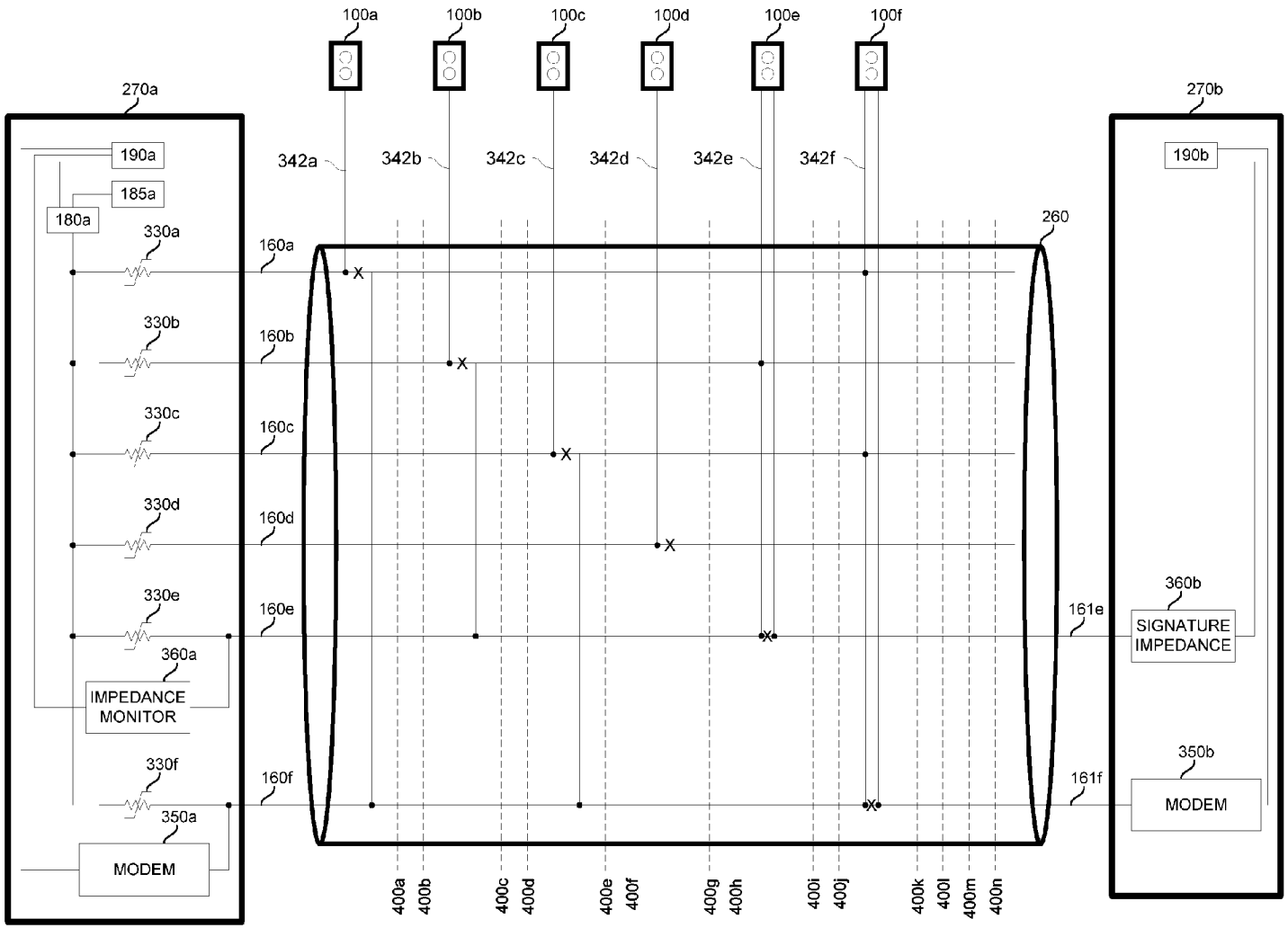
FIG. 3 is an electrical schematic showing traffic signal beacon connection of a motorist warning and bridge collapse detection system in accordance with the present invention.

FIG. 3 is an electrical one-line diagram showing beacon connection. Controller 270*a* contains a processor 190*a* and a DC power supply 185*a* with an optional battery backup. Processor 190*a* determines if cable 260 has been broken using impedance monitor 360*a* to monitor for the presence of signature impedance 360*b* located in remote controller 270*b*. Modems 350*a-b* form a datalink between processors 190*a* and 190*b* to allow for passage of diagnostic and health information. Alternatively, loss of signal between modems 350 may be used in addition to or as a replacement to monitoring for a signature impedance 360*b* to determine if cable 260 has been broken. Any other means of detecting a cable break may be employed.

When parted cable 265 has been detected, processor 190*a* changes the state of beacons from off to alternating between top beacon on and bottom beacon on with about a one-second interval. Encoder 180*a* encodes this state for transmission to beacons 100 *a-f*. Encoding the state onto a single pair of wires 160 per beacon 100 is especially important when bridge 210 is over a mile long. Other well-known methods suffer from requiring an additional wire for the each lamp within each beacon, which is only utilized half of the time in the case of a flashing beacon. Also important is the use of low-voltage power as this allows a safe voltage to be used in case of accidental human contact. Allowing DC/DC converter 120 to accept a wide input voltage range allows use of smaller conductors.

Each beacon 100 is wired to controller 270*a* with a dedicated pair of wires 160*a-f* within multi-pair cable 260. Each X in the diagram shows how each pair of wires 160 is cut immediately after each beacon 100. This allows any short across one or more pairs 160 which may likely develop during the collapse and creation of parted cable 265 from disabling any beacon 100*a-c* located before the collapse. Such an event would fail to warn motorist 220*a* of the impending danger. Connections on pairs of wire 160*d-f* to disabled beacons 100*d-f* may be either open or short due to parted cable 265. PTCs 330*a-f* limit any fault current associated with each respective beacon 100*a-f* to a value which is easily tolerated by the system. Alternatively, fuses or other current limit means may be incorporated. Short wires 342*a-f* may connect each beacon 100*a-f* to its respective pair of wires 160*a-f* in cable 260. For pairs of wire 160*e-f*, which must be run the entire length of the bridge to allow for collapse detection, the pair is cut and run to beacons 100*e-f*, which provide resistors 170 for connection to controller 270*b* via pairs of wire 161 *e-f*, such that a collapse after cable anchor 400*h* would not disrupt the operation of beacons 100*e-f*.

Figure 4:
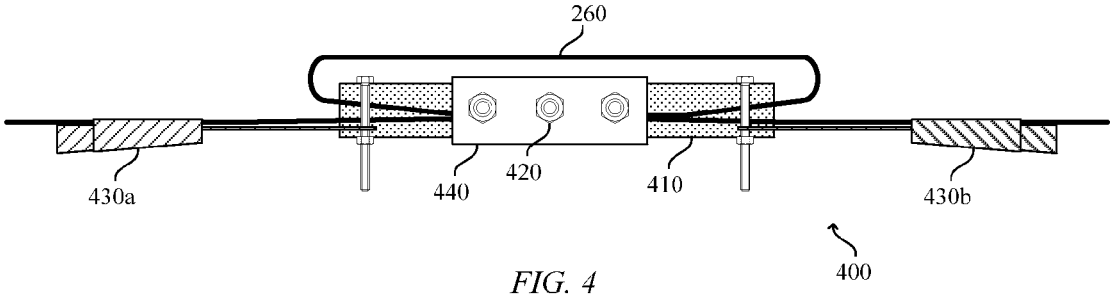
FIG. 4 illustrates a cable anchor/breaker installed periodically along the length of the bridge in accordance with the present invention.

FIG. 4 illustrates a cable anchor/breaker located at each beacon 100. Cable anchor 400 securely attaches cable 260 to bridge 210 via bolt 420. Cable 260 is a standard multi-pair aerial telecommunications drop wire. The tension of cable 260 from running between other cable anchors 400 is relieved with standard P-clamps 430*a-b* commonly used with drop wire 260. P-clamp 430 is attached to unistrut 410. Cable 260 wraps around from the inside of the unistrut channel to the outside of the channel, and back to the inside of the channel. Unistrut U bracket 440 prevents cable 260 from falling out of unistrut 410 even under adverse conditions. A cable anchor 400 is placed on each side of each expansion joint of bridge 210. This gives a reasonable span of cable 260 between cable anchors 400, and a small displacement across an expansion joint can produce enough force to break cable 260. A multitude of other varieties of cables, clamps, and brackets are readily envisioned.

Upon collapse of bridge 210, a large displacement occurs between two adjacent cable anchors 400. The resulting force exceeds the breaking tension of either P-clamp 430*a* or P-clamp 430*b*. Cable 260 is no longer strain-relieved and now is under the large force associated with the falling bridge. Cable 260 is pulled into contact with the edge of unistrut 410. This large force applied to a relatively sharp bend breaks cable 260 at the bend, thus individually severing each pair of wires. The edges of Unistrut 410 need not be specifically sharpened. The breaking tension of a six-pair drop wire is on the order of 1 000 lbs. This is quite sufficient to prevent accidental breakage and is easily overcome by a falling bridge. Normally, cable 260 does not come in contact with the edge of unistrut 410, and therefore experiences no wear. Significant advantages of low-voltage power are the use of standard telephone drop wire as cable 260 in conjunction with cable anchor 400, and that cable 260 need not be run in conduit. An advantage of using of telephone drop wire is the need for only two bolts per protected section of bridge, one at each end, need be drilled into bridge 210. One well-known system installed on the Queen Isabella Memorial Causeway leading to Port Isabel, TX, requires three conduits run the entire length of the bridge along with 96 holes per 80 foot span drilled into the concrete.

Figure 5:
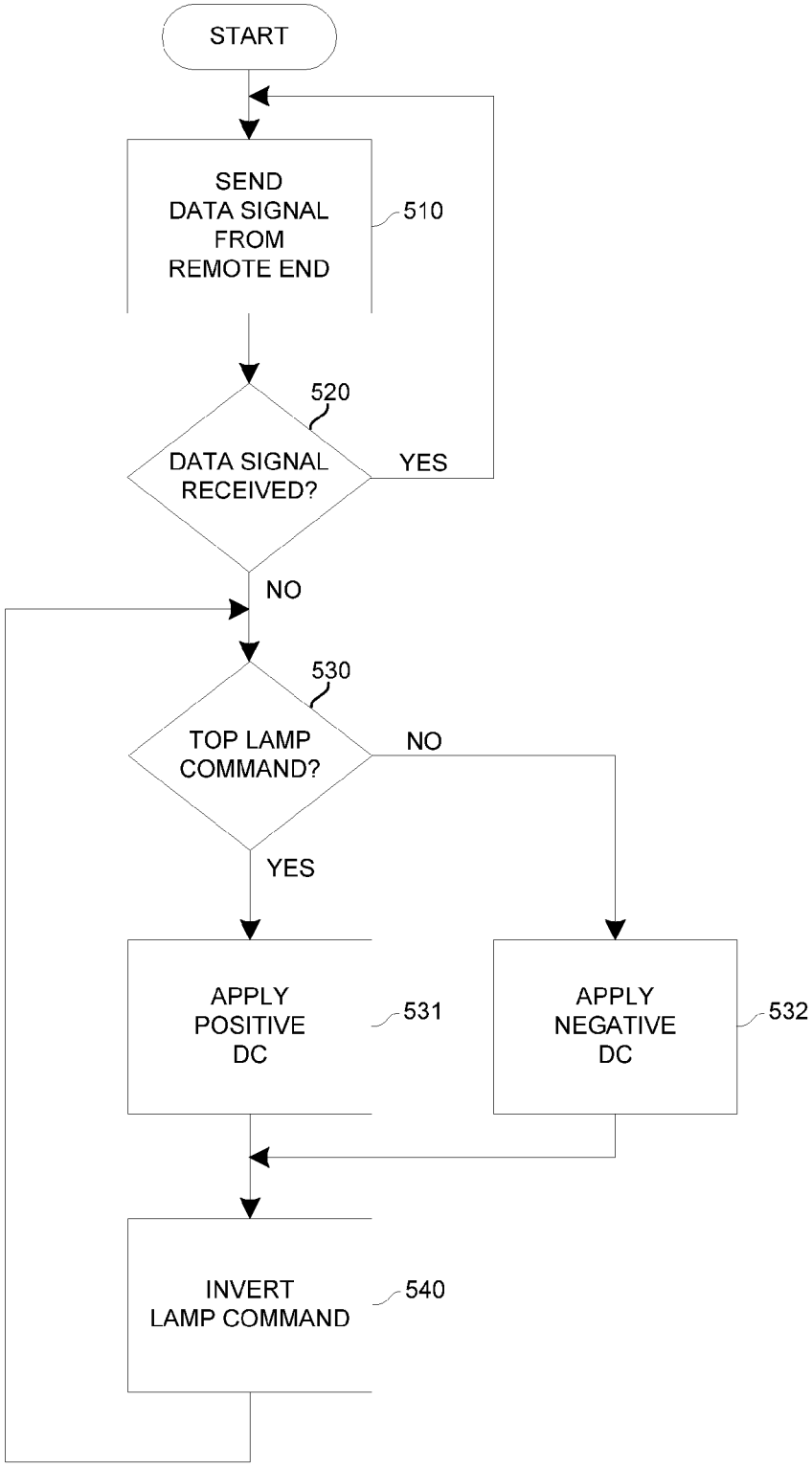
FIG. 5 is a flowchart demonstrating one method of detecting and warning of a structural failure in accordance with the present invention.

FIG. 5 is a flowchart demonstrating one method of detecting a structural collapse. A signal is sent in step 510 and is monitored for in step 520. If the signal is received, cable 260 is intact along with bridge 210. This process is repeated indefinitely. If the signal is not received, the bridge has collapsed and an immediate warning to multiple motorists 220*a* already on the bridge and to those not yet on the bridge is provided. Sending any signal capable of easy detection of the signal's presence or absence is suitable.

A command to turn on a lamp 140 in all beacons 100 is issued. This command is encoded into a desired state in step 530. Positive DC is applied to each pair in cable 260 in step 531, which is decoded to illuminate top lamp 140*a* in all beacons. After about 1 second, the desired state is inverted in step 540, which sends a negative DC to cable 260 in step 532, illuminating bottom lamp 140*b*.

Although embodiments of the invention and their advantages are described in detail, a person skilled in the art could make various alterations, additions, and omissions without departing from the spirit and scope of the present invention as defined by the appended claims.

What is claimed is:

1. A system for controlling a multitude of traffic signal lamps comprising:

a system controller that is operable to encode three or more desired states of said lamps, where power and said encoded state are transmitted on a single pair of wires;

one or more said lamps that are grouped into one or more beacons;

a decoder located inside each said beacon that is operable to decode said desired state of said lamps; and power is applied to the selected said lamp.

2. The system of claim 1, where said power is low-voltage DC and said lamps are LEDs.

3. The system of claim 1, where a multitude of states are operable to a multitude of lamps, said multitude of lamps communicates traffic commands to motorists to control the flow of traffic at a traffic intersection.

4. The system of claim 1, where said encoded state can produce no conflicting illuminated lamps.

5. The system of claim 1, where said encoded state employs polarity encoding.

6. The system of claim 1, where said controller is operable to detect failure of said lamps.

7. The system of claim 1, where a series of one or more of said beacons are flashing red beacons containing one or more of said lamps that notify a motorist approaching a collapsed bridge of the imminent hazard; and where said beacons located past the point of said bridge collapse are disabled by said collapse.

8. The system of claim 7, where said power is home run between each said beacon and said controller and not capable of affecting the operation of any other said beacon.

9. The system of claim 7, where wiring for each said beacon is anchored to said bridge and loss of electrical continuity indicates collapse of said bridge.

10. The system of claim 9, where said anchor also severs said cable when said cable is overtensioned.

11. The system of claim 7, where emergency response services is notified of said collapsed bridge.

12. A system for controlling a multitude of traffic signal lamps comprising:

a means to encode three or more states to produce a selected illumination of said lamps, where said encoding means cannot produce a conflicting state of said lamps;

a means to electrically power said lamps, where said power and said encoded state require a single pair of wires; and a means to decode said state and illuminate said lamps.

13. The system of claim 12, where said power means utilizes low-voltage DC power and said encoding means includes reversing the polarity of said power.

14. The system of claim 12, where a means to alert motorists to a collapsed bridge includes one or two of said signal lamps enclosed in a single beacon housing and a multitude of said signal beacons are spaced across said bridge;

where said beacons are powered by a cable;

where said beacons are illuminated upon collapse of said bridge;

where only said beacons located in advance of said collapse are illuminated; and where said beacons located after said collapse are turned off by a disconnect means.

15. The system of claim 14, where said disconnect means includes a means to attach said power cable to said bridge such that collapse of said bridge will break said cable; and where said cable break also provides means to detect said collapse.

16. The system of claim 15, where said disconnect means independently disconnects the power to each said beacon beyond said collapse.

17. A method of controlling traffic flow including:

signaling motorists with a one or more signal lamps residing in each of one or more signal beacons;

encoding a plurality of selected traffic commands, where said encoding encodes three or more states onto a pair of wires, where said encoding is sent to a plurality of said beacons, where electric power is sent to a plurality of said beacons, and where each said beacon is operable to decode said command and actuate corresponding said lamp within each said beacon.

18. The method of claim 17, where said method of controlling traffic flow is operable to stop flow of traffic on a causeway in the event of a collapse of said causeway;

where said beacons are flashing;

where said flashing beacons are illuminated before a motorist reaches said collapse and not illuminated after said collapse;

where a metallic cable is firmly attached to said causeway such that said cable will fail during said collapse;

where interruption of said cable turns off said beacons after said collapse;

where a short circuit cannot disable said beacons located before said collapse and a method of initially detecting said collapse via monitoring of said failed cable.

19. The method of claim 18, where each said beacon comprises two alternating red LED lamps;

said encoding to each said beacon includes applying a positive DC to illuminate one said lamp within said beacon; and applying a negative DC illuminates an opposing said lamp within said beacon.

20. The method of claim 18, where said method of firmly attaching said cable to said causeway such that said cable will fail during said collapse includes wrapping said cable around a metallic edge, such that the large force of a falling bridge severs said cable on said metallic edge.

* * * * *